US005435491A

United States Patent [19]

Sakuma

[11] Patent Number: 5,435,491

[45] Date of Patent: Jul. 25, 1995

[54] AIR MIXED TYPE SPRAY APPARATUS

[75] Inventor: Hideo Sakuma, Kawasaki, Japan

[73] Assignee: Alloy Kohki Co., Ltd., Kawasaki, Japan

[21] Appl. No.: 230,753

[22] Filed: Apr. 21, 1994

[51] Int. Cl.[6] ..... B05B 7/08

[52] U.S. Cl. ..... 239/296; 239/298; 239/299; 239/424.5; 239/DIG. 14

[58] Field of Search ..... 239/290, 296, 298, 299, 239/407, 418, 423, 424, 424.5, 430, 433, DIG. 14, 601

[56] References Cited

U.S. PATENT DOCUMENTS

| | | | |
|---|---|---|---|
| 1,897,173 | 2/1933 | Long et al. | 239/601 X |
| 1,990,823 | 2/1935 | Gustafsson | 239/290 X |
| 2,051,210 | 8/1936 | Gustaffson | 239/290 |
| 2,101,175 | 2/1937 | Gustaffson | 239/290 X |
| 2,138,300 | 11/1938 | Gustaffson | 239/290 X |
| 2,646,313 | 7/1953 | Peeps | 239/296 |
| 4,349,153 | 9/1982 | Johnson | 239/296 X |
| 4,386,739 | 6/1983 | Kwok | 239/296 |
| 4,854,504 | 8/1989 | Hedger, Jr. et al. | 239/296 X |
| 5,249,746 | 10/1993 | Kaneko et al. | 239/296 |

FOREIGN PATENT DOCUMENTS

| | | | |
|---|---|---|---|
| 773020 | 12/1967 | Canada | 239/290 |
| 5790762 | 6/1982 | Japan | 239/290 |
| 25881 | 7/1983 | Japan . | |
| 59-139958 | 8/1984 | Japan . | |
| 62-160156 | 7/1987 | Japan . | |
| 1278818 | 8/1989 | Japan . | |
| 448823 | 11/1992 | Japan . | |
| 520367 | 4/1940 | United Kingdom | 239/290 |

*Primary Examiner*—Andres Kashnikow
*Assistant Examiner*—Lesley D. Morris
*Attorney, Agent, or Firm*—Fitzpatrick, Cella, Harper & Scinto

[57] ABSTRACT

A spray nozzle member jets out paint in a fan-shaped pattern. Air streams are jetted from a conically annular center air nozzle in such a way as to surround the fan-shaped pattern, whereby a conically atomized spray pattern is discharged from a deformed opening. Notches formed on the deformed opening cause the conical pattern to spread, and fan-shaped air streams produced by air from auxiliary air nozzles promote the spreading of the spray pattern to a greater extent. Oblique air streams are forwardly supplied from side air nozzles into that pattern, so that a fan-shaped spray pattern is again produced. Paint under a pressure of several kg/cm$^2$ is discharged from a spray nozzle. An atomizing air stream, except the part thereof corresponding to the edge of the fan-shaped spray, converges on the front extremely close to the spray nozzle. The atomizing air stream is discharged under a pressure of less than 2 kg/cm$^2$ such that a flat liquid film is surrounded and the atomizing air stream is caused to collide with a fan-shaped liquid flow. A spreading stream results from reaction caused by the collision of converging air streams from both sides, and causes a jet to be effectively atomized and formed into a conical pattern, thereby producing a conical spray. Air from side air nozzles and auxiliary side air nozzles causes the conical spray to be transformed to a fan-shaped spray having a wide angle while tailing is prevented.

12 Claims, 4 Drawing Sheets

AIR MIXED TYPE SPRAY APPARATUS

BACKGROUND OF THE INVENTION

1. Field of the Invention

This invention relates to an air mixed type spray apparatus for spraying liquid such as paint or the like, and more particularly to a spray apparatus that can selectively produce spray in a conical or fan-shaped pattern and yield a preferable result despite the fact that liquid and air are sprayed under a considerably low pressure.

2. Description of the Prior Art

Basic types of spray applied by a conventional spray apparatus for painting purposes chiefly fall into three types: namely, an air spray type, an airless spray type and an air mixed spray type.

Generally, in an air spray type apparatus, paint is emitted from a circular paint spraying hole under a considerably low pressure, and a vast amount of air is jetted from an annular air spraying hole formed around the paint spraying hole under a relatively high pressure. The stream of this jetted air causes paint to be atomized. The air spray type apparatus is adapted to painting to which metallic paint is applied. However, if necessary, various types of auxiliary air holes are formed around the annular air spraying hole to promote the atomization of paint or regulate a spray pattern.

In an airless spray type apparatus, paint which is pressurized to a considerably high pressure in excess of several tens kg/cm$^2$ or thereabouts is sprayed from an orifice type paint spraying hole, and the paint is atomized by colliding with ambient air, thereby generally producing a fan-shaped spray.

An air mixed spray has been developed in which advantages of both the air spray and the airless spray are incorporated, and advances have been made in putting this spray into practical use (for example, see Japanese Unexamined Patent Publications No. 59(1984)-139958 and No. 62(1987)-160156, and Japanese Utility Model Publication No. 4(1992)-48823). The feature of the air mixed spray is that paint is sprayed from an orifice type paint spraying hole under a relatively high pressure of several kg/cm$^2$ to several tens kg/cm$^2$ or thereabouts and a fan-shaped spray is formed. Air for promoting the atomization of paint which has a lower pressure as compared with the pressure of the paint is added to this spray from outside. The air for promoting atomization is added to the spray in such a way as to surround it. This prevents the scattering of the spray and leads to an improved efficiency of adhesion of coating. Various auxiliary air streams are added to a spray in order to improve it and correct the shape thereof. In addition to the prior techniques as set forth, there are, for example, Japanese Unexamined Patent Publications No. 58(1983)-109153 and No. 4(1992)-18952.

Heretofore, the suppression of destruction of the environment, the improvement of the working environment, the safety management of work, and the saving of resources and energy, or the like, have been advocated. Recently, these have become particularly strictly required in painting work. The painting work now encounters the important subjects: an improvement in efficiency of adhesion of paint by preventing the scattering of a spray; the suppression of the amount of volatile diluting solvent used in paint; and the suppression of a jetting pressure as well as a reduction in pressure loading of paint and air to as low as possible simultaneously with the suppression of the amount of pressurized air used in painting.

In practice, in the prior art as is shown in the Unexamined Patent Publications and the Unexamined Utility Model Publication set forth above as the examples of conventional techniques, it is important to set the jetting pressure of paint to substantially 20 kg/cm$^2$ or thereabouts and set the jetting pressure of air to more than 5 kg/cm$^2$ or thereabouts. In order to reduce the degree of pressure, it becomes necessary to set the viscosity of paint to a considerably low level by increasing the amount of diluting fluid. Thus, it is quite difficult to reduce the jetting pressure while the viscosity of the paint is maintained or increased.

A drop in discharging pressure, particularly, the discharging pressure of air, affects the environment in front of a spray apparatus. Specifically, the conditions of the addition of air to spray; namely, a collision angle of air to spray, a collision strength, and the symmetrical property of air streams with each other are easily abnormally affected. This results in a significant imperfection, that is, a spray having an uneven particle diameter and a disordered distribution pattern. This also requires a paint nozzle and an air nozzle which are manufactured with high accuracy, thereby resulting in a considerably expensive manufacturing cost and hence rendering the spray apparatus disadvantageous.

Moreover, in the airless spray apparatus which uses an orifice type spray nozzle, it is difficult to obtain a practically circular spray. Particularly, in one type of spray apparatus that uses a fan-shaped spray nozzle with a lip-like discharge orifice, once a fan-shaped spray is formed, and air streams are blown to the edges of that fan-shaped spray to make the spray circular inevitably, the diameter of the spray is reduced, and a circular pattern having a practical diameter is not obtained.

The apparatus disclosed in aforementioned Japanese Unexamined Patent Publication 58(1983)-109153 produces an effect when air is sprayed under a high pressure. Two pairs of nozzles that are disposed opposite to each other must be axially aligned precisely to each other, and also the positional relationship between the nozzles and nozzle chips thereof must be strictly maintained. If these are not achieved, the shape of a fan-shaped spray pattern is disturbed, or initial objects, i.e. an even fan-shaped spray pattern and an improved spraying state cannot be attained, thereby rendering this apparatus disadvantageous. Moreover, this technique basically belongs to an airless spray type, and the chief object thereof is to prevent so-called tailing from occurring in a fan-shaped spray produced by an airless type spray. For this reason, relatively highly pressurized air is locally supplied to a fan-shaped spray from a nozzle having a small diameter. Also, the airless type spray apparatus produces a spray at a high pressure, and therefore this high pressure brings about poor color tone or uneven metallic color when this apparatus is applied to metallic painting. Thus, this apparatus cannot be applied to metallic painting.

One example of a spray gun that realizes a reduced amount of air and a reduced air pressure is disclosed, for instance, in Japanese Unexamined Patent Publication 4(1992)-18952. In this spray gun, air is caused to collide with both edges of fan-shaped spray jetted from a paint nozzle from outside, so that the fan-shaped spray is temporarily concentrated on the center. Thereafter, a fan-shaped spray is formed while it is shifted 90° away from the fan-shaped pattern jetted from the paint nozzle. Accordingly, it is difficult for the spray gun to obtain a fan-shaped spray having a wide angle. To obtain a fan-shaped spray having a wide angle, it is necessary to supply strong air for flattening purpose. This makes it difficult to obtain an orderly arranged fan-shaped spray, and the efficiency of adhesion of paint drops because of the considerable scattering of spray. A conical spray has a considerably narrow angle, and therefore a practical conical spray cannot be obtained.

SUMMARY OF THE INVENTION

In view of the foregoing observations, the primary object of this invention is to provide an inexpensive air-mixed type spray apparatus suitable for painting that enables superiorly atomized spray having a stable pattern to be easily obtained even when the supply pressure of paint and air is low.

Another object of this invention is to provide an inexpensive air-mixed type spray apparatus that can produce a fan-shaped spray having a wide angle while the occurrence of tailing is prevented.

Still another object of this invention is to provide an air-mixed type spray apparatus that can be used with either solid type paint or metallic type paint.

A further object of this invention is to provide an air-mixed type spray apparatus that can produce a conical spray having a relatively large diameter which can be put into practice by the selection of an air supply.

To achieve these objects, in one aspect of the present invention, there is provided an air-mixed type spray apparatus comprising:

(a) a spray nozzle member for jetting out liquid such as paint in a fan-shaped pattern; and (b) an air nozzle member for producing an air stream coaxially disposed with the spray nozzle member with a predetermined space therebetween in such a way that a substantially conical center air nozzle is formed between the air nozzle member and the outer surface of the spray nozzle member;

the air nozzle member including a substantially truncated-cone-shaped inner surface, whose vertex locates at the center axis in front of and close to the spray nozzle member, formed at the center of the air nozzle member;

a truncated-cone-shaped cylinder part having a deformed opening defined by a pair of notches which are formed on the outer surface of the center of the air nozzle member and aligned in the direction of the diameter thereof with the coaxial line interposed therebetween; and a pair of projections formed on both sides of the air nozzle member in a forwardly projecting manner;

the center air nozzle jetting out, at a low pressure, a center air stream whose components, in the same direction of the diameter in which the notches are aligned, partially do not converge and whose components, in the direction orthogonal to the diameter direction, converge on the center axis just in front of and extremely close to the spray nozzle member; and the projections having two sets of auxiliary side air nozzles for jetting out air streams opposite to each other that collide head on with each other in the vicinity of the outer end of each of the notches, thereby rendering conical in shape an air-added paint spray jetted from the spray nozzle member and the air nozzle member; and side air nozzles, each being interposed between each set of the auxiliary side air nozzles, in such a way that jetted oblique air is forwardly added to both sides of the conical spray.

According to another aspect of this invention, the present invention provides an air-mixed type spray apparatus comprising:

an orifice type fan-shaped spray nozzle, for spraying liquid such as paint in a fan-shaped pattern, fixed to the end of a truncated-cone-shaped holder in such a way that a fan-shaped spray from the fan-shaped spray nozzle is elongated;

an air nozzle member disposed coaxially with the fan-shaped spray nozzle around the area close to the end of the holder with an appropriate clearance between the holder and the air nozzle member, and having a truncated-cone-shaped cylinder part locating at the center thereof, a substantially truncated-cone-shaped inner surface whose vertex locates at the center axis close to and in front of the fan-shaped spray nozzle, a deformed opening formed by notching in the direction of the diameter of the truncated conical cylinder a part of the truncated-cone-shaped inner surface which is close to the front end thereof, and forward projections formed on both sides of the truncated conical cylinder; and a substantially conically annular center air nozzle formed by the truncated-cone-shaped outer peripheral surface of the holder and the notched truncated-cone-shaped inner surface of the air nozzle member, whereby the substantially conically annular center air nozzle jets, at a pressure lower than a jetting pressure of the liquid, a center air stream whose components in the direction of the diameter partially do not converge and whose components in the traverse direction thereof converge on the center axis extremely close to and in front of the fan-shaped spray nozzle;

the projections having two pairs of auxiliary side air nozzles inwardly formed for jetting air streams that collide head on with each other at the locations close to the outer end of each of the notches in such a way that a conical spray can be produced, and side air nozzles respectively formed between the two pairs of auxiliary side air nozzles so that oblique jet air therefrom can be forwardly added to both sides of the conical spray.

In one preferred mode, an orifice type fan-shaped nozzle is fixed to the end of a truncated-cone-shaped holder in such a way that a fan-shaped spray therefrom is elongated. Liquid such as paint is discharged from this fan-shaped spray nozzle in a fan-shaped pattern under a low pressure of, for example, less than several $kg/cm^2$ or thereabouts. An air nozzle member having a truncated-cone-shaped cylinder part formed at the center end thereof is coaxially disposed at the area close to the front end of the holder with an appropriate clearance being kept between them. The conically cylindrical inside of the air nozzle member is formed into a truncated-cone-shaped inner surface, with the rear thereof widely open, whose vertex locates at the center axis extremely close to and in front of the fan-shaped spray nozzle.

Part of the truncated-cone-shaped inner surface close to the front end thereof is notched in the direction of the diameter of the truncated-cone-shaped cylinder, thereby forming a deformed opening. The truncated-cone-shaped outer peripheral surface of the holder and the notched truncated-cone-shaped inner peripheral surface of the air nozzle member constitute a substantially conically annular air nozzle. This air nozzle jets a center air stream whose components in the direction of the diameter do not converge but whose components in the traverse direction of that diameter converge on the center axis extremely close to and in front of the fan-shaped spray nozzle.

Air under a low pressure of, for example, 2 kg/cm$^2$ or thereabouts or, preferably, 0.5 to 1 kg/cm$^2$ which is lower than the jetting pressure of the jetted liquid is added to the liquid jetted in the form of a fan-shaped film while surrounding the jetted liquid from the base thereof.

Forward projections are formed on both sides of the truncated-cone-shaped cylinder part of the air nozzle member. Two pairs of auxiliary air nozzles for preventing tailing and widening the angle of a fan-shaped pattern are inwardly formed on these forward projections to jet air streams which collide head on with each other at the locations close to the outer end of each of the notches formed on the air nozzle member. A fan-shaped air stream having a wide angle is produced by the collision of jet air from these auxiliary air nozzles. A confluent air stream, composed of this fan-shaped air stream with a wide angle and the portion of the center air stream jetted from the notches, guides a spray in the direction of the diameter. The converging center air stream forcefully collides with both sides of a fan-shaped discharged liquid, and the jetted liquid is atomized while it is spread in the direction orthogonal to the direction of the diameter because of the reaction resulting from the collision between the center air stream and the fan-shaped discharged liquid. Thereby, a substantially conical spray having a relatively wide angle can be formed unless air is discharged from the auxiliary air nozzles.

As facilities for causing a conical spray to be flattened like a fan-shaped spray, a side air nozzle is formed between the auxiliary side air nozzles formed on each projection in such a way that oblique air is forwardly jetted to both sides of the conical spray. Two sets of smoothing air nozzles, which are slightly inwardly directed, each being composed of a number of nozzles, are forwardly formed on both sides of the center air nozzle. Thus, oblique air streams for guiding and spreading purposes are forwardly jetted into the air streams from the side air nozzles in such a direction that the oblique air streams cross each other. Hence, the guiding and spreading air streams and the fan-shaped air stream with a wide angle resulting from the collision of jet air from the auxiliary air nozzles cooperatively act, and this causes the spray to be flattened and atomized.

As an airless type fan-shaped spray nozzle, as described in Japanese Utility Model Publications No. 2(1990)-5881 and No. 1(1989)-27881, a fan-shaped spray nozzle having a wide angle should preferably be adopted in which a substantially saddle-like paint nozzle is defined by making an inside trench and an outside trench cross each other, both having inclined side surfaces and a substantially V-shaped cross section.

With the above configuration, liquid such as paint is jetted from the airless type fan-shaped spray nozzle under a low pressure of less than several kg/cm$^2$ or thereabouts. An air stream under a pressure of less than 2 kg/cm$^2$ or thereabouts or, in some cases, 0.5 kg/cm$^2$ with a tendency to converge is discharged from the conically annular center air nozzle and is caused to collide with a flat liquid film immediately after it has been discharged from the spray nozzle. A spreading steam resulting from the reaction of the air stream that converges while surrounding the flat liquid film causes a jet to be effectively atomized and conically shaped.

Particularly, the upstream portion of the center air nozzle is conically annular in shape, but the discharge orifice thereof has truncated conical shape and has notches aligned in the direction of the diameter of the discharge orifice. Because of such a configuration, the portion of the air stream jetted from the center air nozzle that corresponds to the notches fails to converge, whilst the other portion thereof converges on the position along the center axis extremely close to the front of the fan-shaped spray nozzle. Hence, the air stream jetted from the center air nozzle forcefully collides with both sides of a fan-shaped liquid flow, and the fan-shaped liquid flow spreads particularly to the traverse direction thereof. As a result of this, the jet is effectively atomized and conically shaped, and a circular pattern is obtained unless any other flattening action is applied to the jet.

Air streams jetted from the auxiliary side air nozzles that are opposite to each other collide head on with each other to produce a fan-shaped air stream having a wide angle. A confluent air stream, composed of the fan-shaped air stream with a wide angle and the air stream from the notches of the center air nozzle, promotes the atomization and spreading of elements included in the fan-shaped spray which cause tailing.

Side air streams are supplied to the spray thus thrust from the side air nozzles, and hence the angle of the spray is made wider in the same direction as the initial fan-shaped liquid flow, thereby producing a fan-shaped spray. Spray-form shaping nozzles formed on both sides of the deformed opening jet out a plurality of air streams which are close to each other, and these oblique smoothing air streams are forwardly jetted to the advancing direction of the side air streams in such a direction that they cross each other. Thereby, the advancing direction of the side air streams is limited to the direction of the center, and the side air streams are also spread. Thus, the smoothing air streams are helpful in making the spray appropriately flat, and the collision of the side air streams suppresses the spreading of the spray with a tendency to surround the fan-shaped spray and are helpful in improving the efficiency of adhesion of paint.

The jetting pressure of the airless type fan-shaped spray nozzle and the discharging pressure of the annular center air nozzle are considerably low, and hence a fan-shaped spray whose thrusting speed is low is produced. The air stream under a low pressure around the fan-shaped spray nozzle converges while surrounding a fan-shaped jet from the base thereof. In this process, the air stream is concentratedly added to the fan-shaped jet with a tendency to increase its speed, thereby realizing effective atomization. After having been atomized, the jet spreads with its speed decreasing. The jetting pressure of other added air can be set to considerably low, and therefore the scattering of fog drips during the thrusting process and a rebounding phenomenon on the surface to which paint is adhered are suppressed.

The fan-shaped spray nozzle has a saddle-like paint spraying hole defined by arranging the inside trench and the outside trench, both having inclined side surfaces and a substantially V-shaped cross section, in a crucifix pattern. The adoption of this fan-shaped spray nozzle advantageously leads to a fan-shaped spray having a considerably wide angle. However, when the jetting pressure of a fan-shaped spray obtained by the use of such a cross-cut type nozzle is low, the atomization of both edges of the fan-shaped spray becomes significantly difficult.

The air jetted from the center air nozzle in such a way as to conically converge causes an atomizing action. A part of the fan-shaped air stream having a wide angle resulting from the collision of air jetted from the auxiliary air nozzles collides with the edges of the fan-shaped jet, thereby causing an atomizing action. Because of these atomizing actions, a superiorly atomized fan-shaped spray having a wide angle is obtained.

DETAILED DESCRIPTION OF THE INVENTION

Figure 1:
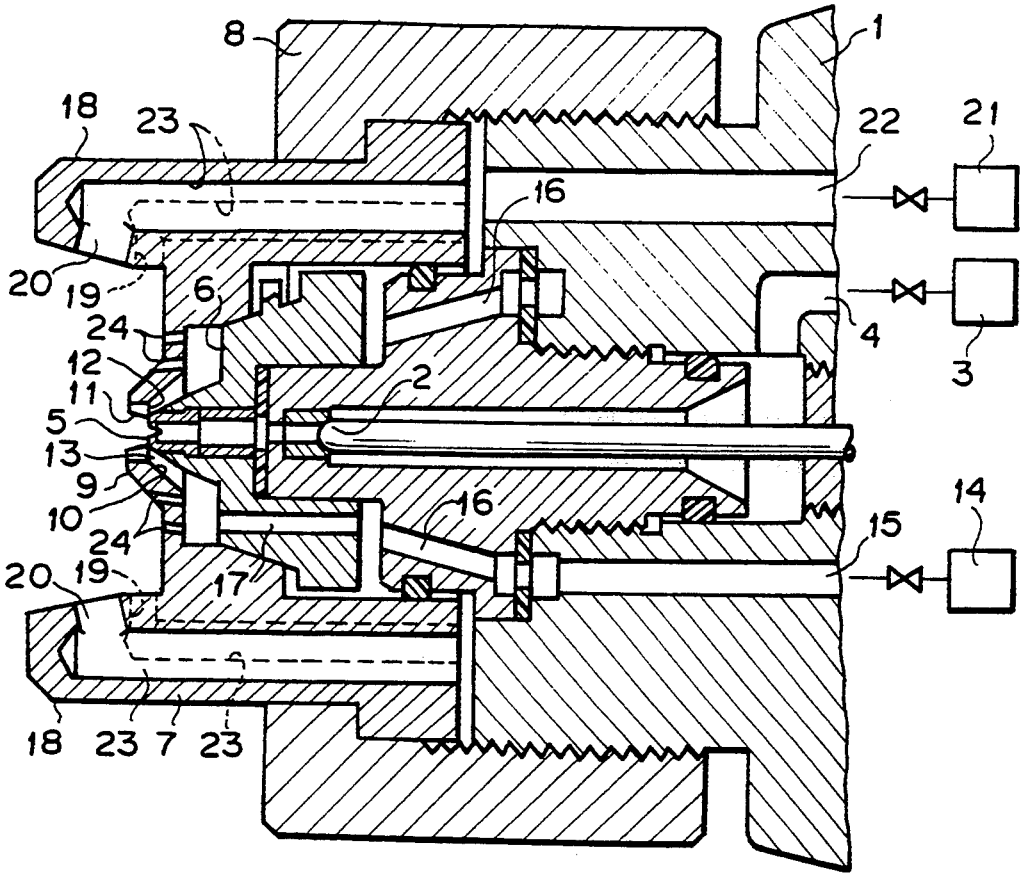
FIG. 1 is a partial longitudinal cross-sectional view showing a spray apparatus according to this invention.
Figure 2:
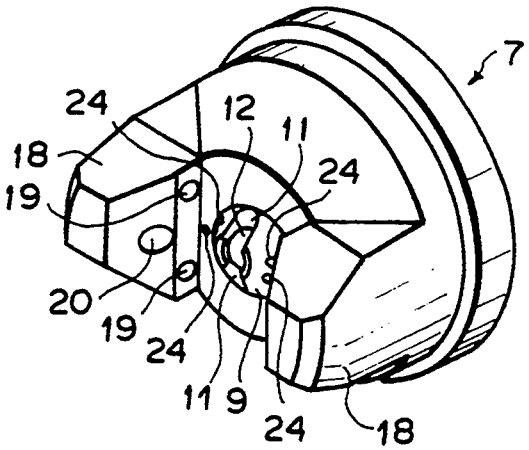
FIG. 2 is a perspective view showing an air nozzle member alone.
Figure 3:
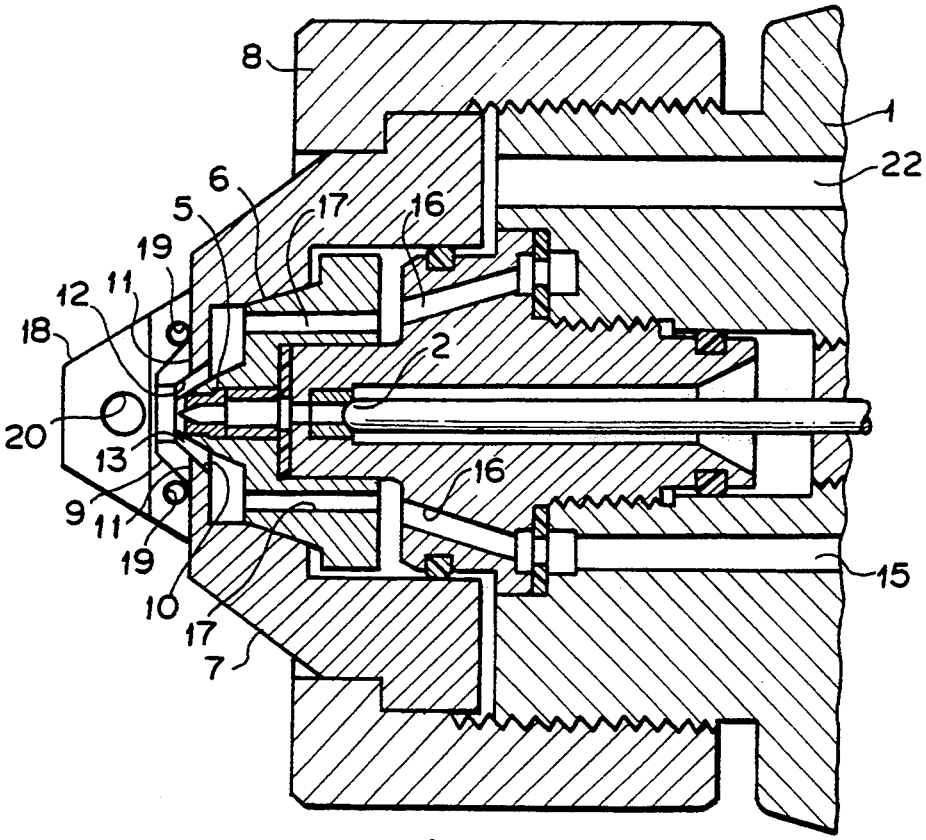
FIG. 3 is a longitudinal cross-sectional view showing the spray apparatus.
Figure 4:
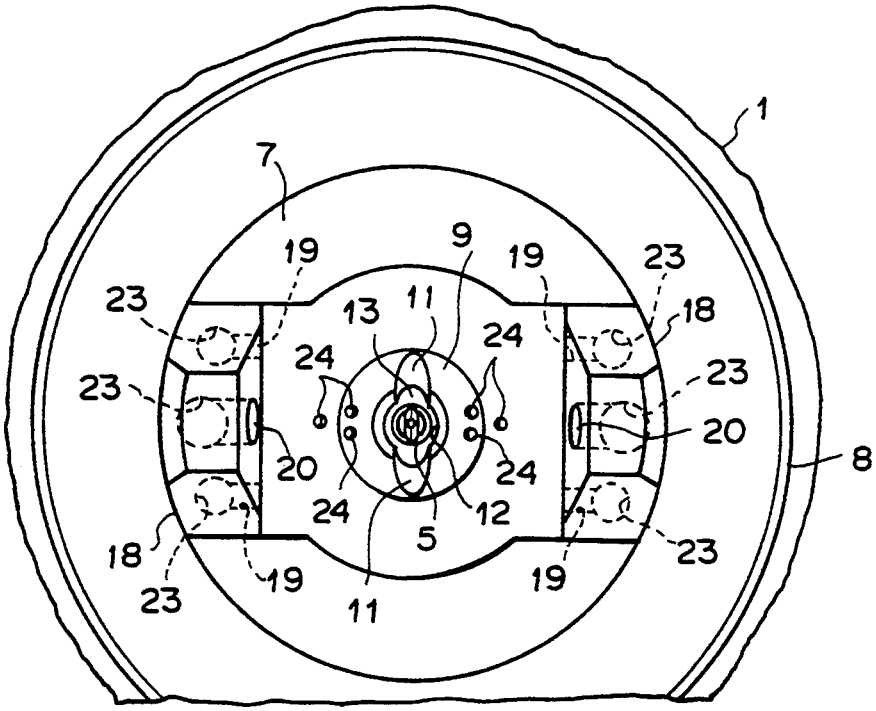
FIG. 4 is a partially broken front view showing the spray apparatus.

With reference to the accompanying drawings, preferred embodiments of this invention will now be described in detail.

As illustrated in FIGS. 1 to 4, an opening/closing valve 2 consisting of a valve seat and a needle valve which advances to and recedes from the valve seat is disposed at the center of a spray gun body 1 close to the end thereof. This spray gun body is arranged so that pressurized paint supplied from a supply source 3 via a channel 4 can be supplied forward in accordance with the opening action of the opening/closing valve 2. A holder 6 to which an orifice type fan-shaped spray nozzle 5 is fixed is coaxially fitted to the front end of the spray gun body 1 in such a way that a fan-shaped jetted stream therefrom is elongated. The end of this holder 6 is formed into a truncated cone. An air nozzle member 7 is coaxially fitted over the holder 6, and is fastened to the spray gun body 1 with a nut 8. The area of this air nozzle member 7 that is in the vicinity of the front end thereof and also close to the center thereof is formed into a truncated-cone-shaped cylinder part 9. A truncated-cone-shaped inner surface 10 is formed inside at the center of the truncated-cone-shaped cylinder part 9. The vertex of the truncated-cone-shaped inner surface 10 is inwardly spread, so that it has a sharp inclination of several tens of degrees or thereabouts. A trench having a substantially U-shaped or V-shaped cross section is transversely formed on the front surface of the truncated-cone-shaped cylinder part 9 in such a way as to cross the truncated-cone-shaped inner surface 10, whereby notches 11 are formed in the direction of the diameter of the truncated-cone-shaped cylinder part. The combination of this truncated-cone-shaped inner surface 10 with the notches 11 constitutes a deformed opening 12. A center air nozzle 13 is formed by a relatively narrow conical slit defined between the truncated-cone-shaped portion of the holder 6 close to the front end thereof and the truncated-cone-shaped inner surface 10. Pressurized air is supplied to this center air nozzle 13 from a pressurized air supply source 14 via channels 15, 16 and 17.

The discharge orifice of the center air nozzle 13 consists of the deformed opening 12 and the truncated cone portion of the holder 6 close to the front end thereof, and is annularly conical in shape. This discharge orifice locates considerably close to the base of a fan-shaped spray jetted from the orifice type fan-shaped spray nozzle 5, and hence the air jetted from the center air nozzle 13 collides with the base of the fan-shaped jet and also converges while surrounding the jet, so that the discharge air is concentratedly added to the jet with a tendency to increase its speed. Thereby, effective atomization is realized by the collision of a fan-shaped liquid film with the converging air stream simultaneously when a spray stream having a closely conical shape is formed.

Forward projections 18 are formed on the front end face of the air nozzle member 7 symmetrically about the plane along the direction of the diameter including the center axis. Two pairs of auxiliary air nozzles 19 prevent tailing and cause a spray to be formed in the shape of a fan, and these pairs of auxiliary air nozzles are formed on the projections 18 for air streams which collide head on with each other at the positions adjacent to the outer end of each of the notches 11. These auxiliary air nozzles 19 are arranged substantially parallel to the plane for symmetry in such a way as to be opposite to each other, and are also directed to the outside of the notches 11 formed on the conical surface of the truncated-cone-shaped cylinder portion 9. Fan-shaped air streams are produced by the collision of air jetted from these auxiliary side air nozzles 19. A confluent air stream composed of these fan-shaped air streams and the air stream from the notches 11 of the center air nozzle 13 promotes the atomization of the elements of a fan-shaped spray which cause tailing and the spreading of the spray.

Moreover, a side air nozzle 20 for the purpose of flattening is formed between the pair of auxiliary side nozzles 19 which are formed adjacent to each other on each projection 18. Pressurized air is supplied to the auxiliary side air nozzles 19 and the side air nozzles 20 from a pressurized air supply source 21 via channels 22 and 23. The air jetted from these nozzles causes side air to be obliquely and forwardly supplied into both sides of the conical spray. Two sets of smoothing air nozzles 24, each set consisting of three nozzles, are formed in air nozzle member 7. The sets of nozzles 24 are located on diametrically opposed sides of the center air nozzle 13.

With this arrangement, a part of the air supplied to the center air nozzle 13 is utilized in promoting the forward advancement of the air stream. Thus, oblique air streams for guiding and spreading purposes are forwardly jetted into the side air streams sprayed from the side air nozzles 20 in such a direction that the oblique air streams cross each other.

Figure 5:
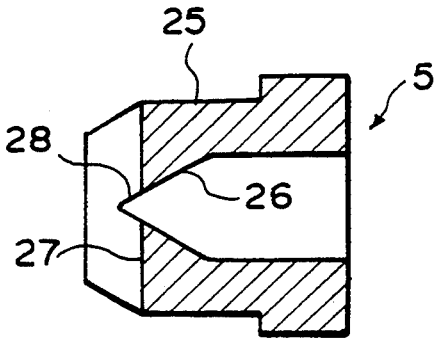
FIG. 5 is a longitudinal cross-sectional view showing cross-sectional view showing a fan-shaped spray nozzle.
Figure 6:
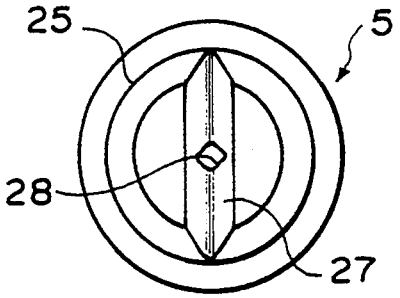
FIG. 6 is a front view showing the fan-shaped spray nozzle.
Figure 7:
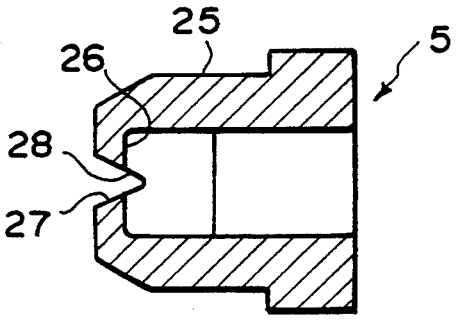
FIG. 7 is a longitudinal cross-sectional view showing the fan-shaped spray nozzle.

As shown in FIGS. 5–7, the spray nozzle that is preferable as the orifice type fan-shaped spray nozzle 5 comprises a nozzle body 25 made of hard material such as hard metal or ceramics; a wedge-like inside trench 26 having a substantially V-shaped cross section which is formed with the rear thereof open in such a way that the groove does not completely pass through the nozzle body 25 and the periphery of the nozzle body 25 is left; and an outside trench 27 having a V-shaped cross section formed on the end of the nozzle body 25 in such a way that it crosses the inside trench 26 in the form of a crucifix, thereby forming a saddle-like spray hole 28. However, if it is unnecessary for the fan shape of the spray to have a wide angle, the nozzle that is preferable as the fan-shaped spray nozzle 5 may comprise a lip-like orifice type paint nozzle defined by the nozzle of a commonly used type, i.e. a dome-like inside hole and an outside trench having a V-shaped cross section which crosses the dome portion formed on the end of the dome-like inside hole.

Figure 8:
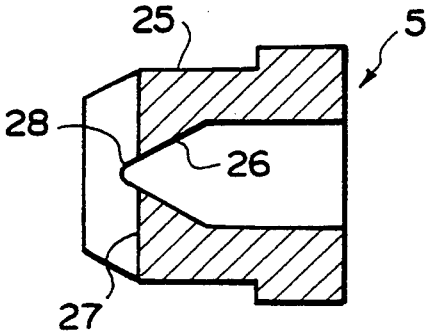
FIG. 8 is a longitudinal cross-sectional view showing a fan-shaped spray nozzle according to a second embodiment of this invention.
Figure 9:
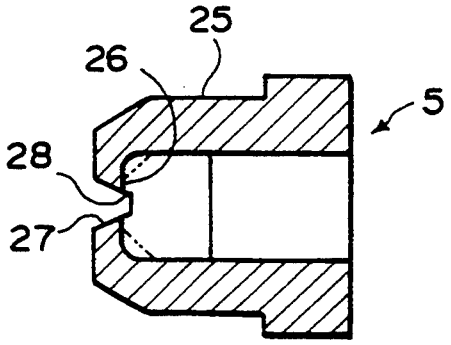
FIG. 9 is a longitudinal cross-sectional view showing a fan-shaped spray nozzle according to a third embodiment of this invention.

As the most preferable structure for the fan-shaped spray nozzle 5, as shown in FIGS. 8 and 9, the bottom of the inside trench 26 is appropriately rounded, and the outside trench 27 is formed so that the cross section thereof takes the form of a trapezoid. The inside trench 26 may be formed like drooping shoulders in which both ends of thereof are rounded or provided with an oblique fillet surface.

Figure 10:
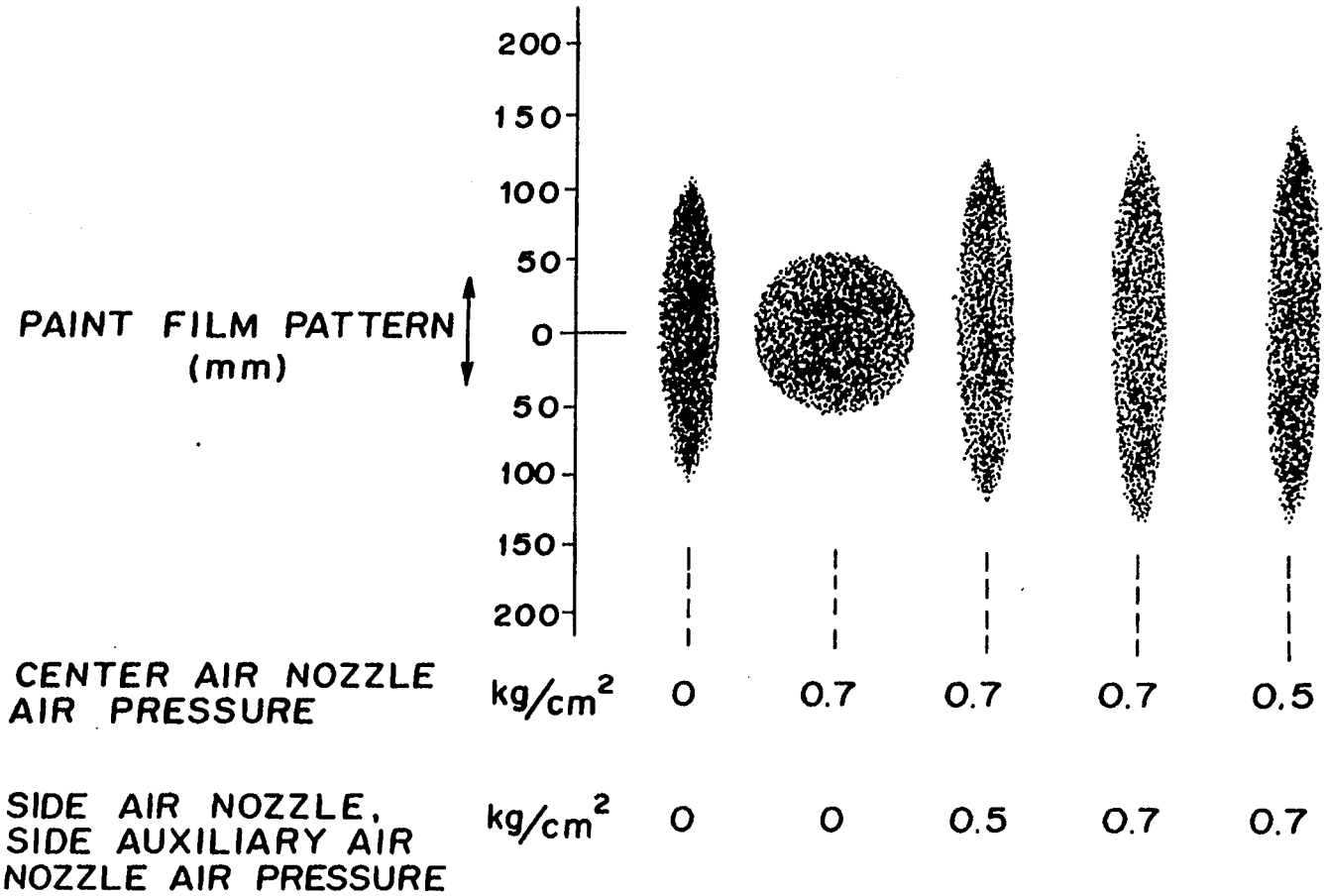
FIG. 10 is a diagram illustrating patterns of a paint film when the spray apparatus according to this invention is used.

The spray apparatus according to this invention was put into practice in a room under specific conditions; namely, Ford cup #4 viscosity, metallic painting for sixteen seconds, 4 kg/cm$^2$ pressure, 200 mm spraying distance, and 14° C. temperature. When paint is instantaneously sprayed, a nearly even paint film pattern is obtained without causing tailing as shown in FIG. 10 by variously combining a jetting air pressure from the center air nozzle 13 and the smoothing air nozzle 24 with the jet air pressure from the side air nozzles 20 and the auxiliary size air nozzles 19. Moreover, it was observed that a paint film pattern is arbitrarily and easily obtained over a wide range of patterns from a circular pattern to a considerably long elongated circular pattern by the selection and combination of pressure of supplied air.

The initial object can be sufficiently attained by a liquid pressure of less than 4 kg/cm$^2$ and an air pressure of less than 0.7 kg/cm$^2$. However, a superior result can be obtained even when the liquid and air are supplied under a higher pressure. A facility for applying electrostatic charges to spray is added to the spray apparatus of this invention so that the spray apparatus may be used as an electrostatic spray apparatus. Alternatively, the spray apparatus of this invention may be used as an ultrasonic spray apparatus by adding a facility for ultrasonic atomization thereto. In either case, a capacity for atomization is considerably improved, and the efficiency of adhesion of spray is far improved in the case of the electrostatic spray apparatus.

As described above, the following effects are obtained according to this invention:

(a) Liquid such as paint is jetted in a fan-shaped pattern from an orifice type fan-shaped spray nozzle, and the center air stream is added to surround this fan-shaped liquid flow. Particularly, concerning the center air, the air stream in which the remaining portions of the fan-shaped liquid flow, except for the portions corresponding to both edges of the fan-shaped liquid flow, converge on the front considerably close to the fan-shaped spray nozzle is jetted so that it collides with the fan-shaped liquid flow. Hence, a spreading stream is produced by reaction resulting from the collision of a confluent air stream with both sides of the flat liquid film while it surrounds the flat liquid film. By virtue of this spreading stream, a jet is effectively atomized and shaped into a conical pattern, whereby conical spray having a relatively wide angle can be formed.

(b) The center air nozzle, having a substantially conical annular shape, with notches that locate at the positions corresponding to both ends of a fan-shaped spray from the fan-shaped spray nozzle is constituted. The air streams jetted forwardly from the notches of this center air nozzle are combined with the air streams which are jetted from two pairs of auxiliary side air nozzles and collide head on with each other at the positions close to both ends of the notches. Thereby, the elements that cause tailing are definitely atomized, and colliding air streams spread outside at a wide angle. Hence, the cooperative action of the colliding air streams and the jet air stream from the center air nozzle contributes to the widening of an angle of spray.

(c) Because of the atomization caused by a converging air stream and the atomization of edges of air streams from the auxiliary side air nozzles which collide head on with each other, the atomizing action is considerably improved. Hence, the supply pressures of liquid and air can be readily decreased.

(d) The smoothing air nozzles are formed, and a number of streams of oblique air flow are forwardly jetted to the front of the jet air streams from the side air nozzles in such a direction they cross the side air streams. The advancing direction of the side air streams is regulated to the center, and the width of the side air streams is widened, so that spray is appropriately flattened. Hence, this is helpful in making atomization uniform.

(e) As an orifice type fan-shaped spray nozzle, a fan-shaped spray nozzle comprising the substantially saddle-like paint nozzle that is defined by causing the inside trench and the outside trench, both having inclined side surfaces and a substantially V-shaped cross section, to be crossed together in the form of a crucifix is adopted. Not only is spray having a wide angle easily obtained, but also the effective atomization of the edges caused by the air streams which collide head on with each other results in the adoption of the saddle-like nozzle hole type fan-shaped spray nozzle for which it is difficult to prevent the occurrence of tailing.

(f) The adoption of the center air nozzle that jets an air stream converging on both sides close to the base of the fan-shaped spray leads to conical spray having a relatively wide angle. Additionally, separate side air nozzles are formed, and hence the selective supply of air to both nozzles and the regulation of the supply pressure of the same enable the shape and size of spray to be arbitrarily selected. Neither shape or size cause tailing, and superior atomization is effected. Accordingly, it is possible to regulate the width of a fan-shaped pattern over a wide range by means of only one spray gun, and the spray apparatus is convenient as a spray apparatus that enables switching to circular patterns having a practical size.

(g) Most of the air streams which are added to a fan-shaped jet erupted from the fan-shaped spray nozzle are supplied so as not to make the angle of the fan-shaped pattern of the fan-shaped jet narrower. Not only is a fan-shaped spray having a wide angle easily obtained, but also the angle of conical spray can be twice that compared with a conventional conical spray. Hence, it is possible to paint a wide area with high efficiency.

(h) A fan-shaped liquid jet flow is atomized while it is surrounded by sufficient air streams from the center air nozzle and the side air nozzles or the like. The angle of a fan shape is wide, that is, the density of the jet flow is diluted, and the supply pressure of air is low. Therefore, despite the fact that the air-mixed type spray is adopted, this air spray apparatus is suitable for metallic painting in the same manner as an air spray type. Hence, as with the case where an automobile is painted by painting robots, the spray apparatus of this invention is suitable for color switching painting in which a plurality of color paints including metallic paint are frequently switched.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to persons skilled in the art.

What is claimed is:

1. An air-mixed type spray apparatus comprising:

(a) a spray nozzle member for jetting out liquid forwardly thereof in a fan-shaped pattern, said spray nozzle having an outer surface; and (b) an air nozzle member having a center axis for producing an air stream coaxially disposed with said spray nozzle member with a predetermined space therebetween to define a substantially conical center air nozzle between said air nozzle member and said outer surface of said spray nozzle member;

said air nozzle member including an outer surface including a center portion around said center axis;

a substantially truncated-cone-shaped inner surface formed about said center axis having a vertex located at said center axis in front of and close to said spray nozzle member;

a conical cylinder part having a deformed opening defined by a pair of notches formed on said outer surface of the center portion of said air nozzle member and aligned about said center axis in diametrically opposed positions along a first diameter thereof; and a pair of diametrically opposed projections formed on said air nozzle member and extending in a forwardly projecting manner away from the spray nozzle in spaced relation to said center axis;

said center air nozzle jetting out at a low pressure a center air stream whose components, in the direction of said first diameter in which said notches are aligned, partially do not converge and whose components, in a direction orthogonal to said first diameter, converge on said center axis just upstream of and extremely close to said spray nozzle member; and said pair of projections having:

(a) two sets of auxiliary side air nozzles, one set being provided on each projection and including two auxiliary side air nozzles for jetting out air streams opposite to each other that collide head on with each other upstream of said notches, thereby rendering conical in shape an air-added paint spray jetted from said spray nozzle member and said air nozzle member; and (b) side air nozzles, interposed between said auxiliary side air nozzles and positioned to obliquely jet air forwardly to be added to both sides of said conical spray.

2. An air-mixed type spray apparatus as defined in claim 1, wherein said spray nozzle member is fixed to the end of a truncated-cone-shaped retaining means having a truncated-cone-shaped outer peripheral surface and an inside cylindrical surface, and said center air nozzle is connected to the space formed between the truncated-cone-shaped outer peripheral surface of said retaining means and said truncated conical inner surface of the air nozzle member.

3. An air-mixed type spray apparatus as defined in claim 1, wherein said spray nozzle member has inside and outside surfaces and includes a paint spray nozzle defined by an inside trench, which has a substantially V-shaped cross section, formed on the inner surface of said spray nozzle member, and an outside trench formed on the outer surfaces of said spray nozzle member with said inside and outside trenches crossing each other.

4. An air-mixed type spray apparatus as defined in claim 2, wherein said spray nozzle member has inside and outside surfaces and a paint spray nozzle defined by an inside trench, which has a substantially V-shaped cross section, formed on the inner surface of said spray nozzle member, and an outside trench formed on the outer surface of said spray nozzle member cross each other.

5. An air-mixed type spray apparatus as defined in claim 1, wherein at least two smoothing nozzles are formed on both sides of said center air nozzle, and said smoothing nozzles forwardly jet oblique air streams into side air streams from said side air nozzles for guiding and spreading the side air streams.

6. An air-mixed type spray apparatus as defined in claim 2, wherein at least two smoothing nozzles are formed on both sides of said center air nozzle, and said smoothing nozzles forwardly jet oblique air streams into side air streams from said side air nozzles for guiding and spreading the side air streams.

7. An air-mixed type spray apparatus as defined in claim 3, wherein at least two smoothing nozzles are formed on both sides of said center air nozzle, and said smoothing nozzles forwardly jet oblique air streams into side air streams from said side air nozzles for guiding and spreading the side air streams.

8. An air-mixed type spray apparatus as defined in claim 4, wherein at least two smoothing nozzles are formed on both sides of said center air nozzle, and said smoothing nozzles forwardly jet oblique air streams into side air streams from said side air nozzles for guiding and spreading the side air streams.

9. Air-mixed type spray apparatus comprising:

spray nozzle means including a central axis and an orifice for spraying liquid in a fan-shaped pattern, fixed to the end of a truncated-cone-shaped holder in such a way that a fan-shaped spray from said spray nozzle means is elongated;

an air nozzle member disposed coaxially with said spray nozzle means and surrounding said end of said holder in spaced relation therewith to define an appropriate clearance between said holder and said air nozzle member, said air nozzle member having a truncated conical cylinder having a central portion located coaxially with the central axis of said spray nozzle means including a substantially truncated-cone-shaped inner surface having a front end including a vertex located on said center axis close to and in front of said spray nozzle means, a deformed opening formed therein, said deformed opening being defined by diametrically located notches formed in said truncated-cone-shaped inner surface close to the front end thereof, and two diametrically opposed parallel projections formed thereon and projecting forwardly of said truncated conical cylinder; and said holder having a truncated-cone-shaped outer peripheral surface and said truncated-cone-shaped inner surface of said air nozzle member being spaced from one another to define therebetween a substantially conically annular center air nozzle, whereby said substantially conically annular center air nozzle jets out, at a pressure lower than a jetting pressure of said liquid, a center air stream whose components in the direction of said notches partially do not converge and whose components in the traverse direction of the notches converge on the center axis extremely close to and in front of said fan-shaped spray nozzle;

said projection each having a pair of auxiliary side air nozzles formed therein and directed inwardly towards the central axis for jetting air streams that collide head on with each other at locations close to and upstream of said notches to produce a conical spray, and side air nozzle formed between said pair of auxiliary side air nozzles to form an oblique air jet therefrom directed forwardly to be added to both sides of said conical spray.

10. An air-mixed type spray apparatus as defined in claim 9, wherein smoothing air nozzles are forwardly formed on both sides of said center air nozzle, and forwardly jet oblique air streams into the side air streams jetted from said side air nozzles for guiding and spreading said side air streams.

11. An air-mixed type spray apparatus as defined in claim 9, wherein spray nozzle means includes a fan-shaped spray nozzle having a wide angle orifice formed therein and a substantially saddle-like paint spraying hole defined by an inside trench and an outside trench crossing each other, both having inclined side surfaces and substantially V-shaped cross section.

12. An air-mixed type spray apparatus as defined in claim 10, wherein said spray nozzle means includes a fan-shaped spray nozzle having a wide angle orifice formed therein and a substantially saddle-like paint spraying hole defined by an inside trench and an outside trench crossing each other, both having inclined side surfaces and substantially V-shaped cross section.

* * * * *